US011423828B2

(12) United States Patent
Shao et al.

(10) Patent No.: US 11,423,828 B2
(45) Date of Patent: Aug. 23, 2022

(54) LIGHT-EMITTING DIODE (LED) BRIGHTNESS NON-UNIFORMITY CORRECTION FOR LED DISPLAY DRIVER CIRCUIT

(71) Applicant: TEXAS INSTRUMENTS INCORPORATED, Dallas, TX (US)

(72) Inventors: Haibin Shao, Shanghai (CN); Yan He, Shanghai (CN); Qingjie Ma, Shanghai (CN); Wei Xu, Suzhou (CN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 17/135,906

(22) Filed: Dec. 28, 2020

(65) Prior Publication Data

US 2022/0208076 A1 Jun. 30, 2022

(51) Int. Cl.
*G09G 3/32* (2016.01)
*G09G 5/10* (2006.01)

(52) U.S. Cl.
CPC ..... *G09G 3/32* (2013.01); *G09G 5/10* (2013.01); *G09G 2320/064* (2013.01)

(58) Field of Classification Search
CPC ..... G09G 3/32; G09G 2320/064; G09G 5/10; G09G 3/006
See application file for complete search history.

(56) References Cited

U.S. PATENT DOCUMENTS 5,508,729 A * 4/1996 Yamazaki ..... B41J 2/45 347/247
2006/0017607 A1* 1/2006 Hayata ..... G01S 7/282 342/134
2007/0052375 A1* 3/2007 Lin ..... G09G 3/3413 315/312
2007/0115248 A1* 5/2007 Roberts ..... G09G 3/3413 345/102
2007/0188484 A1* 8/2007 Gwatkin ..... G09G 3/3413 345/212
2008/0309255 A1* 12/2008 Myers ..... H05B 45/24 315/297
2009/0309510 A1* 12/2009 Liu ..... H05B 45/37 315/291
2010/0045190 A1* 2/2010 Cramer ..... H05B 45/12 315/151
2011/0068713 A1* 3/2011 Hoogzaad ..... H05B 45/48 315/307
2014/0152704 A1* 6/2014 Jeong ..... G09G 3/3233 345/76
2014/0327360 A1* 11/2014 Hoshino ..... H05B 45/22 315/151
2015/0054842 A1* 2/2015 Cornell ..... G06T 15/005 345/581
2015/0130788 A1* 5/2015 Bailiang ..... G06T 15/20 345/419

(Continued)

*Primary Examiner* — Antonio Xavier
(74) *Attorney, Agent, or Firm* — Mark A. Valetti; Charles A. Brill; Frank D. Cimino

(57) ABSTRACT

A light-emitting diode (LED) display driver circuit includes: a set of channels, each channel of the set of channels having a respective current control circuit; and control circuitry coupled to each respective current control circuit and configured to adjust a respective control signal to each respective current control circuit responsive to an LED brightness estimate for each channel of the set of channels.

19 Claims, 6 Drawing Sheets

(56) References Cited

U.S. PATENT DOCUMENTS

| | | | | |
|---|---|---|---|---|
| 2016/0081148 | A1* | 3/2016 | Liang | G01R 31/44 324/414 |
| 2016/0110303 | A1* | 4/2016 | Wei | G06F 13/4221 710/308 |
| 2018/0336827 | A1* | 11/2018 | Zahirovic | G09G 3/3275 |
| 2019/0261473 | A1* | 8/2019 | Cala' | G06F 13/4291 |
| 2019/0364309 | A1* | 11/2019 | Von Braun | H04N 21/44016 |
| 2020/0092963 | A1* | 3/2020 | Xie | H05B 47/16 |
| 2020/0103705 | A1* | 4/2020 | Chen | H05B 45/32 |

* cited by examiner

LIGHT-EMITTING DIODE (LED) BRIGHTNESS NON-UNIFORMITY CORRECTION FOR LED DISPLAY DRIVER CIRCUIT

BACKGROUND

The proliferation of electronic devices and integrated circuit (IC) technology has resulted in the commercialization of IC products. As new electronic devices are developed and IC technology advances, new IC products are commercialized. One example IC product for electronic devices is a light-emitting diode (LED) display driver circuit. In LED display devices (e.g., indoor or outdoor LED signage or displays for stadiums, schools, arenas, billboards, homes, or other LED display devices with multiple LED display driver circuits), there are some trends: the number of red-green-blue (RGB) LED pixels are increasing (e.g., up to 4K pixels and more than 15K LED drivers); the pitch between pixels is decreasing; and the minimum on-time in each period is decreasing (e.g., down to tens of nanoseconds). In at least some scenarios (e.g., an LED display with high dynamic range and high resolution), a decrease in on-time increases the likelihood of non-uniformity at low brightness levels for LED display driver circuits. This is due to each channel output current having a more significant transient current portion as the on-time decreases and due to device/channel transient current variance. The result of non-uniformity for channel output currents across LED display driver circuits is undesirable LED brightness variance for different portions of an LED display.

SUMMARY

In an example embodiment of the description, a light-emitting diode (LED) display driver circuit includes: a set of channels, each channel of the set of channels having a respective current control circuit; and control circuitry coupled to each respective current control circuit and configured to adjust a respective control signal to each respective current control circuit responsive to an LED brightness estimate for each channel of the set of channels.

In another example embodiment of the description, a system includes: a printed circuit board (PCB); a LED display controller mounted on the PCB; a graphics card coupled to the PCB and configured to provide graphics data to the LED display controller, wherein the LED display controller is configured to generate LED data based on the graphics data; and a plurality of LED display driver circuits coupled to the LED display controller, each LED display driver circuit configured to receive respective LED data from the LED display controller. Each LED display driver circuit includes: a set of channels, each channel of the set of channels having a respective current control circuit; and control circuitry coupled to each respective current control circuit and configured to adjust a respective control signal to each respective current control circuit responsive to an LED brightness estimate for each channel of the set of channels.

In another example embodiment of the description, a method includes: obtaining, by control circuitry, a LED brightness estimate for each of a plurality of channels of an LED display driver circuit; providing a control signal, by the control circuitry, to a current control circuit for each of the plurality of channels responsive to the obtained LED brightness estimate; adjusting, by each current control circuit, a resistance responsive to a respective control signal; and outputting, by each respective current control circuit, a current responsive to each adjusted resistance.

DETAILED DESCRIPTION

Figure 1:
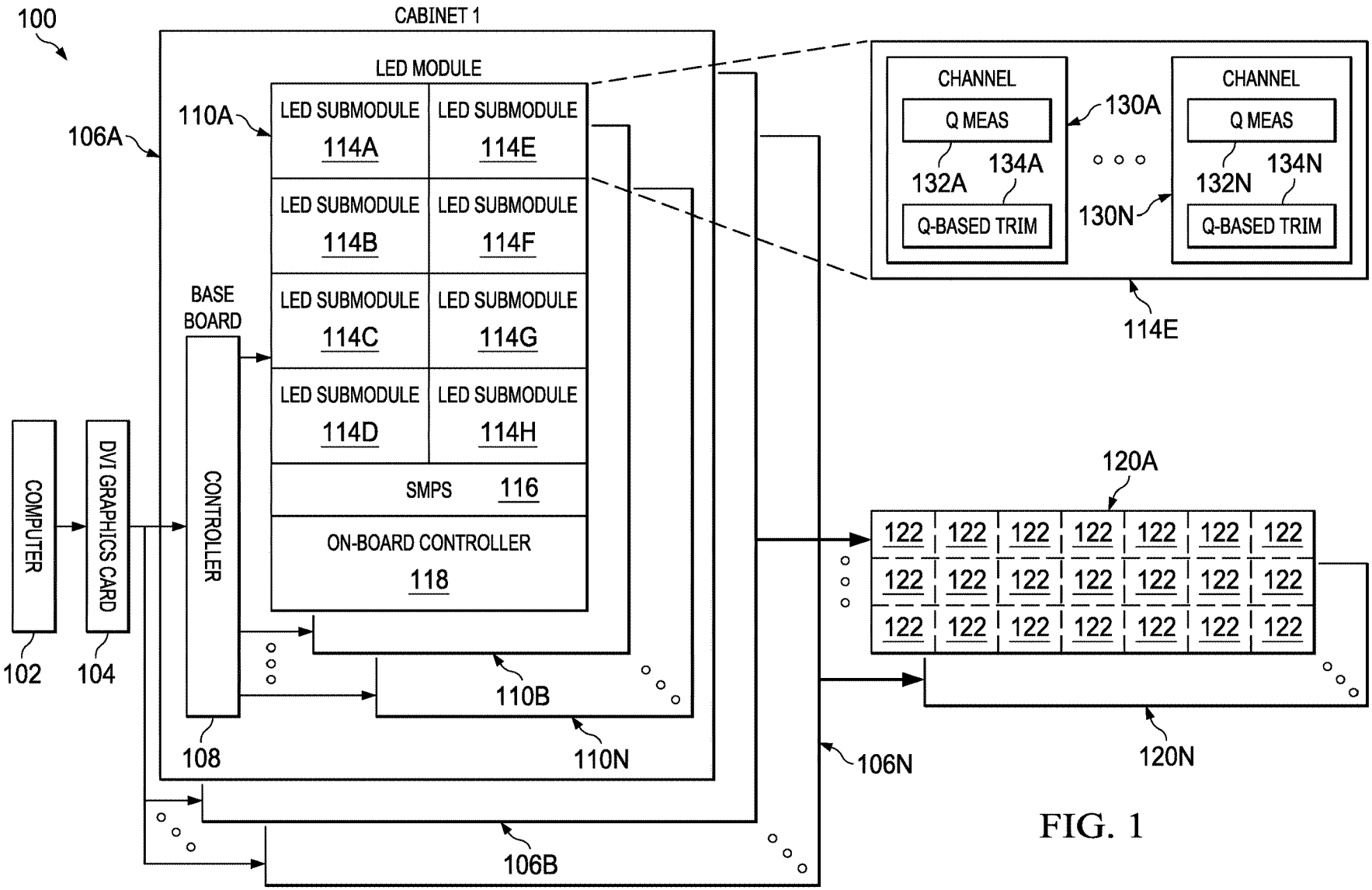
FIG. 1 is a block diagram of a system in accordance with an example embodiment.

Described herein is a light-emitting diode (LED) display driver circuit that includes control circuitry to avoid or correct for LED brightness non-uniformity. In an example scenario, the control circuitry avoids or corrects for channel output current variance during a low LED brightness setting during which the on-time for each period is below a threshold. In some example embodiments, the LED display driver circuit obtains and uses an LED brightness estimate to adjust the channel output current as needed for each of a plurality of channels of an LED display driver circuit. In one example embodiment, the LED display driver circuit obtains a current integration value as the LED brightness estimate for each channel. A current integration value for each channel is provided, for example, by automatic test equipment (ATE) or other external test circuitry subsequent to testing each channel.

In some example embodiments, an LED display driver circuit includes test logic including a configurable pulse generator to generate an on-pulse at each channel output. The on-pulse is provided to external test circuitry for each channel, which enables respective measurements and calculation of a current integration value for each channel. In some example embodiments, the test logic of the LED display driver circuit also includes a communication interface and storage to receive and store the current integration value for each channel. Alternatively, the communication interface and storage receive and store instructions or configuration bits from the external test circuitry responsive to test results (e.g., the current integration value for each channel, or related instruction or configuration bits). Once an LED brightness estimate is provided for each channel (e.g., a current integration value, related instructions, or configuration bits), the LED display driver circuit uses each LED brightness estimate to provide a trim control signal for each channel's current control circuit to avoid or correct for LED brightness non-uniformity In some example embodiments, the external test circuitry calculates the current integration value as:

$$Q = \frac{VM * tp}{Rload}, \qquad \text{Equation (1)}$$

where Q is the current integration value, VM is a sense voltage proportional to a given channel's output current, tp is the on-pulse period at a given channel's output, and Rload is a respective load resistance (part of external test circuitry). In some example embodiments, the external test circuitry includes a processor to calculate the current integration value, where digital values for VM, tp, and Rload are provided to and/or are stored by the processor. In other example embodiments, the LED display driver circuit obtains another LED brightness estimate from external test circuitry. As an example, external test circuitry may employ light sensors and/or another test circuit topology to determine a LED brightness estimate for use by an LED display driver circuit. Responsive to the obtained current integration values or other LED brightness estimates from external test circuitry, control circuitry of an LED display driver circuit adjusts a respective control signal to a current control circuit for each respective channel to avoid or correct for non-uniformity of LED brightness (e.g., by equalizing the channel output currents over time). To provide a better understanding, LED display driver circuits with control circuitry to account for LED brightness non-uniformity and related options and systems are described using the figures as follows.

FIG. 1 is a block diagram of a system 100 in accordance with an example embodiment. In some example embodiments, the system 100 is an LED display device (e.g., indoor or outdoor LED signage or displays for stadiums, schools, arenas, billboards, homes, or other LED display devices with multiple LED display driver circuits). As shown, the system 100 includes a computer 102 that provides the source of the graphics and communicates with a digital visual interface (DVI) graphics card 104. In operation, the DVI graphics card 104 converts graphics source data and provides the data to a plurality of cabinets 106A-106N, where each of the cabinets 106A-106N includes a base board controller 108 and a plurality of LED modules 110A-110N. In different examples, the DVI graphics card 104 provides the same graphics data or different graphics data to each of the cabinets 106A-106N, where each of the cabinets 106A-106N is associated with a different LED display 120A-120N.

In the example of FIG. 1, each of the plurality of LED modules 110A-110N includes a plurality of LED submodules 114A-114H (each an example of an LED display driver circuit described herein), a switched-mode power supply (SMPS) 116, and an on-board controller 118 (sometimes referred to herein as an LED display controller) on a printed circuit board (PCB). In operation, each base board controller 108 is configured to receive graphics data from the DVI graphics card 104 and to provide LED data or related data to each LED module 110A-110N. For example, each on-board controller 118 of each respective LED module 110A-110N is configured to receive LED data or related data from a respective base board controller 108 and to provide a sub-set of the LED data or related data to each of the LED submodules 114A-114H.

In operation, each of the LED submodules 114A-114H is configured to manage the amount of current provided to respective pixel LEDs (e.g., red, green, blue pixel LEDs), where current flow to each pixel LED is a function of scan line operations as well as current control circuit (e.g., a current source or current sink) operations for each channel. As described herein, LED display driver circuits (e.g., the LED submodules 114A-114H) use control circuitry to avoid or correct for LED brightness non-uniformity. In one example scenario, channel output current variance occurs during a low LED brightness setting in which the on-time for each period is below a threshold. With the described control circuitry and related operations, LED brightness non-uniformity at these low LED brightness settings are avoided or corrected.

In FIG. 1, components of an LED submodule for an example embodiment (shown with reference to LED submodule 114E) are shown including a plurality of channels 130A-130N. As shown, each of the channels 130A-130N includes control circuitry in the form of a respective one of current integration (Q) measurement circuits 132A-132N and a respective one of Q-based trim circuits 134A-134N. In some example embodiments, the Q measurement circuits 132A-132N include test logic (e.g., a configurable pulse generator, communication interface, and storage). In some example embodiments, the test logic is configured to provide an adjustable on-pulse for each of the channels 130A-130N for use with external test circuitry (e.g., an ATE and related test circuitry) to determine a Q value or other LED brightness estimate. In one example, the Q measurement circuits 132A-134N and external test circuitry determine a Q value for each of the channels 130A-130N. In some example embodiments, the external test circuitry calculates Q using Equation 1 or another current integration model. In some example embodiments, the external test circuitry includes a processor to calculate an LED brightness estimate such as a Q value, where digital values for VM, tp, and Rload are obtained by the processor. Responsive to the obtained LED brightness estimate or Q value from the external test circuitry, each of the Q-based trim circuits 134A-134N is able to perform a respective trim for each channel as discussed below. In some example embodiments, each Q-based trim circuits 134A-134N are part of a respective current control circuit (e.g., a current source or current sink) for each respective channel. By adjusting trim control signals responsive to an LED brightness estimate (e.g., a calculated Q value), the uniformity of LED brightness is improved (e.g., the trim control signals are determined based on measured Q values and target Q values or a related increase or decrease in current flow). In the example of FIG. 1, each of the LED submodules 114A-114H includes similar components and each is able to perform operations similar to those described for the LED submodule 114E.

In the example of FIG. 1, the plurality of LED displays 120A-120N are coupled to respective cabinets 106A-106N, where each of the LED displays 120A-120N includes LED sections 122 supported by respective LED submodules 114A-114H of the LED modules 110A-110N (e.g., one LED section 122 for each LED submodule). With the described control circuitry (e.g., the Q measure circuits 132A-132N and the Q-based trim circuits 134A-134N) and external test circuitry, non-uniformity of the output current over time from channels of the LED submodules 114A-114H is avoided or corrected such that the LED brightness of each of the LED sections 122 is uniform to within a desired tolerance. The described technique is especially helpful for an LED display with high dynamic range, high resolution, and low LED brightness levels.

Figure 2:
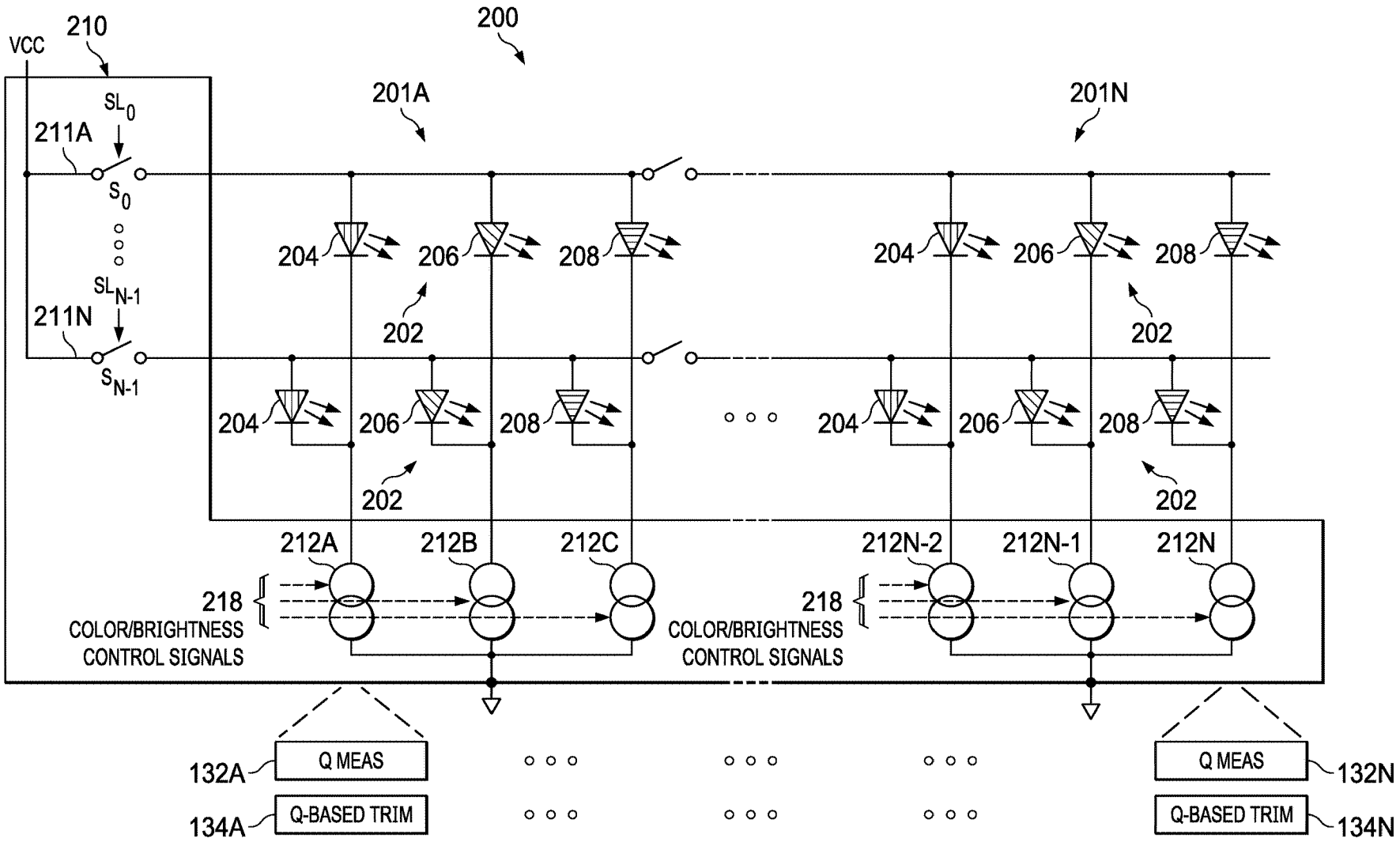
FIG. 2 is a diagram of part of a light-emitting diode (LED) display driver circuit and related sets of pixel LEDs in accordance with an example embodiment.

FIG. 2 is a diagram 200 of part of an LED display driver circuit 210 (e.g., part of each of the LED submodules 114A-114H in FIG. 1) and related sets of pixel LEDs 204, 206, 208 in accordance with an example embodiment. As shown, the diagram 200 includes an LED display driver circuit 210 (e.g., part of an IC) with a plurality of scan lines 211A-211N with respective scan lines switches $S_0$-$S_{N-1}$. As shown, each of the scan lines 211A-211N is coupled to a plurality of channels, each channel having a respective current control circuit 212A-212N (current sinks in FIG. 2) for use with common anode LEDs. In the example of FIG. 2, there are red LEDs 204, green LEDs 206, and blue LEDs 208 with LED anodes coupled to each of the scan lines 211A-211N and with LED cathodes coupled to each of the current control circuits 212A-212N. By controlling the scan lines switches $S_0$-$S_{N-1}$ and respective current control circuits 212A-212N (e.g., current sinks in FIG. 2), pixel color and brightness levels are controlled for each pixel. More specifically, the scan lines switches $S_0$-$S_{N-1}$ are controlled by a sequence of control signals $SL_0$-$SL_N$, and the current control circuits 212A-212N are controlled by color/brightness control signals 218. In other example embodiments, the circuit 210 includes current sources as the current control circuits 212A-212N for use with common cathode LEDs. In such case, LED cathodes are coupled to each of the scan lines 211A-211N, and LED anodes are coupled to each of the current control circuits 212A-212N.

In the example of FIG. 2, the LED display driver circuit 210 includes the Q measurement circuits 132A-132N and the Q-based trim circuits 134A-134N described for the LED submodule 114E in FIG. 1. In the example of FIG. 2, there is a respective Q measurement circuit 132A-132N for each channel. In some example embodiments, the Q measurement circuits 132A-132N include test logic to provide an on-pulse for each channel. In some example embodiments, the test logic includes a configurable pulse generator, a communication interface, and storage. In some example embodiments, the pulse generator includes one or more configurable pulse-width modulation (PWM) circuits coupled to the channel outputs of the LED display driver circuit 210. In some example embodiments, the PWM circuits receive instructions from a communication interface or a controller of the test logic. Without limitation, the communication interface for the test logic is a serial interface of the LED display driver circuit 210 such as a serial peripheral interface (SPI). As needed, test settings for the PWM circuits or other components are stored in volatile or non-voltage memory included with or coupled to the test logic. In one example, the test settings are used to provide control signals to the PWM circuits to generate on-pulses, which are used to determine Q or another LED brightness estimate as described herein.

In some example examples, the on-pulse for each channel is used by external test circuitry (e.g., an ATE and related test circuitry) to determine a Q value or other brightness estimate for each channel. In some examples embodiments, external circuitry coupled to each channel uses the on-pulse provided by the Q measurement circuits 132A-132N to obtain a sense voltage (VM) measurement that is proportional to a channel output current. Once VM is determined, Q is calculated using Equation 1 or another current integration model. In such example embodiments, the external test circuitry includes or uses a processor to calculate Q, where digital values for VM, tp, and Rload are obtained by the processor. As needed, one or more external analog-to-digital converters (ADCs) are used to provide digital values of VM, tp, and Rload to the processor. Once the Q value for each channel is determined, each Q value is provided to the LED display driver circuit 210 for use by Q-based trim circuits 134A-134N.

In the example of FIG. 2, each of the Q-based trim circuits 134A-134N obtains a Q value (or a related control signal) from external test circuitry. The Q value or related control signal is used by the Q-based trim circuits 134A-134N to adjust a trimmable component. In some example embodiments, each of the Q-based trim circuits 134A-134N is integrated with or coupled to one of the current control circuits 212A-212N, and includes a trimmable component such as a trimmable resistor. By adjusting a trimmable component coupled to or integrated with a respective one of the current control circuits 212A-212N, the Q-based trim circuits 134A-134N enable the LED display driver circuit 210 to avoid or correct for non-uniform LED brightness.

Figure 3:
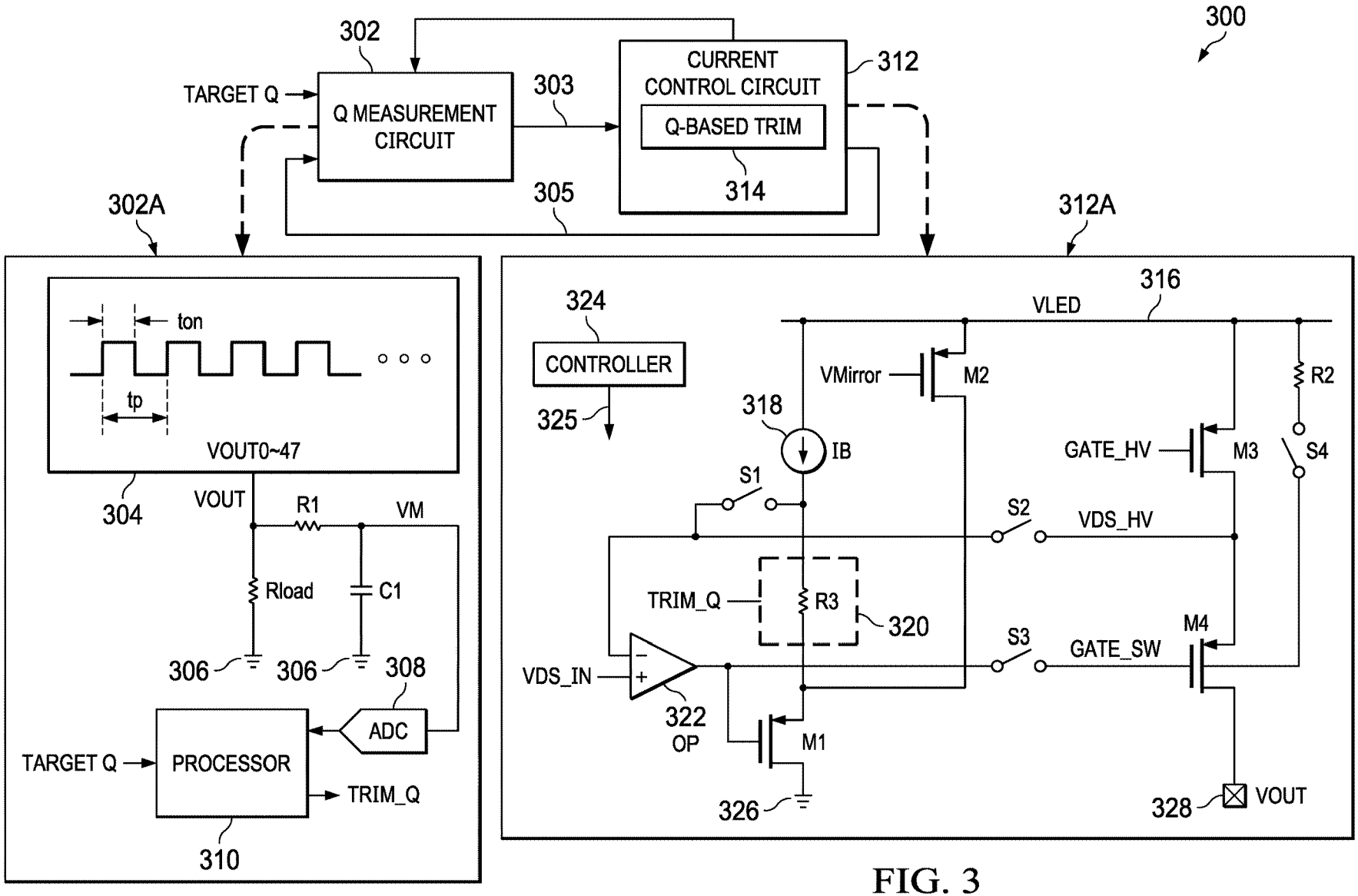
FIG. 3 is a diagram of control circuitry for an LED display driver circuit in accordance with an example embodiment.

FIG. 3 is a diagram of control circuitry 300 for an LED display driver circuit (e.g., one of the LED submodules 114A-114H in FIG. 1, or the LED display driver circuit 210 in FIG. 2) in accordance with an example embodiment. In the example of FIG. 3, the control circuitry 300 includes a Q measurement circuit 302 (e.g., including one of the Q measurement circuits 132A-132N in FIGS. 1 and 2 as well as external test circuitry) and a current control circuit 312 (e.g., one of the current control circuits 212A-212N, 214A-214N, and 216A-216N in FIG. 2) for an LED display driver circuit. In the example of FIG. 3, the Q measurement circuit 302 and the current control circuit 312 (which is illustrated in FIG. 3 as additionally including Q-based trim 314 which is shown separately in FIG. 2 as Q-based trim circuits 134A-134N) are coupled to each other in a loop arrangement. In other words, the current control circuit 312 is adjusted responsive to the Q value or related control signal 303 output from the Q measurement circuit 302. Also, the Q measurement circuit 302 determines the Q value or related control signal 303 based at least in part on an output current 305 from the current control circuit 312. In operation, a Q-based trim circuit 314 of the current control circuit 312 uses the Q value or related control signal 303 to adjust the output current 305 in accordance with a target Q or LED brightness level.

In FIG. 3, the Q measurement circuit 302A is an example embodiment of the Q measurement circuit 302. As shown, the Q measurement circuit 302 includes test logic 304 configured to generate an on-pulse for a given channel of an LED submodule or LED display driver circuit. In some example embodiments, the test logic 304 is part of an LED submodule or LED display driver circuit. In the example of FIG. 3, the Q measurement circuit 302A includes both IC components and external components. The IC components of the Q measurement circuit 302A include the test logic 304. The external components include external test circuitry, an ADC, a processor, etc. Once Q is calculated, the value or a related setting is provided to the IC for use with trimming the current control circuits to avoid non-uniformity issues (at low brightness levels).

More specifically, example components of the test logic 304 include a pulse generator, a communication interface, and a storage. To perform a Q calculation, each channel output (e.g., VOUT0-VOUT47) is coupled to external test circuitry included with the Q measurement circuit 302A. In the example of FIG. 3, the external test circuitry of the Q measurement circuit 302A includes a load resistor (Rload) in parallel with an RC circuit (R1 and C1). Specifically, a first end of Rload is coupled to a channel output and a second end of R1 is coupled to a ground terminal 306. Also, a first end of R1 is coupled to the channel output, the second end of R1 is coupled to a first terminal of C1, and the second terminal of C1 is coupled to the ground terminal 306. As shown, the external test circuitry of the Q measurement circuit 302A also includes an analog-to-digital converter (ADC) 308 and a processor 310.

With the Q measurement circuit 302A, the voltage between R1 and C1 is a sense voltage (VM) proportional to the output current of the channel. In the example of FIG. 3, VM is provided to the ADC 308 to provide a digital VM value to a processor 310. In some example embodiments, the processor 310 determines a Q value for each channel. In one example embodiment, Q for each channel is calculated using Equation 1 or another current integration model. Once the processor 310 has determined the Q value, a related control signal (TRIM_Q) is provided by the processor 310 to a communication interface and storage of the test logic 304 for later use.

In FIG. 3, the current control circuit 312A is an example embodiment of the current control circuit 312. In the example of FIG. 3, the current control circuit 312A has an adjustable output current responsive to various control signals (e.g., VLED, VDS_IN, GATE_HV, GATE_SW, VMirror, and the control signals for S1-S4). As shown, the current control circuit 312A includes a LED voltage supply (VLED) input 316, where the current provided to the channel output terminal 328 is a function of VLED and the operation of various components of the current control circuit 312A. In the example of FIG. 3, the current control circuit 312A includes bias current (IB) source 318, a trimmable component 320, an operational amplifier 322, a controller 324, a resistor (R2), transistors M1-M4, switches S1-S4, a ground terminal 326, and the output current terminal 328. More specifically, the bias current source 318 is coupled to and powered by the VLED input 316. A first end of the trimmable component 320 is coupled to the bias current source 318 and a second end of the trimmable component 320 is coupled to a first current terminal of M1. A second current terminal of M1 is coupled to a ground terminal 326. The first end of the trimmable component 320 is also coupled to an inverting input of the operational amplifier 322 via S1. The inverting input of the operational amplifier also is coupled to the second current terminal of M3 and the first current terminal of M4 via S2. The non-inverting input of the operational amplifier 322 is configured to receive a reference voltage (VDS_IN). As shown, the output of the operational amplifier 322 is coupled to: a control terminal of M1; a control terminal of M4 via S3; and the VLED input 316 via S3, S4, and R2.

The first terminal of M2 is coupled to the VLED input 316, the second current terminal of M2 is coupled to the first current terminal of M1, and the control terminal of M2 is configured to receive a control signal (VMirror). The first current terminal of M3 is coupled to the VLED input 316 and the second current terminal of M3 is coupled to the first current terminal of M4, where the voltage between the second current terminal of M3 and the first current terminal of M4 is given as VDS_HV, and the control terminal of M3 is configured to receive a control signal (GATE_HV). The second current terminal of M4 is coupled to the output current terminal 328. The controller 324 is configured to provide various control signals such as Mirror, GATE_HV, VDS_IN, which are all reference voltages. These reference voltages are active in both on and off states of the current control circuit 312A. Also, in a Q measuring state, the current control circuit 312A is on (S1 and S4 are closed, and S2 and S3 are open). Further, in a trim code application state, the current control circuit 312A is off (S1 and S4 are open, and S2 and S3 are closed).

When the current control circuit 312A is on, the output current at the output current terminal 328 is adjustable responsive to GATE_HV and GATE_SW, where GATE_SW is a function of the value of the trimmable component 320. In the example of FIG. 3, the trimmable component 320 is a trimmable resistor R3, where the value of R3 is adjustable responsive to TRIM_Q. In the example of FIG. 3, the Q-based trim circuit 314 of the current control circuit 312 corresponds to the bias current source 318 and R3 of the current control circuit 312A. The resistance of R3 can be increased or decreased within a predetermined range to cause a proportional increase or decrease in the output current at the output current terminal 328. More specifically if the resistance of R3 is increased, the output current at the output current terminal 328 is increased. Alternatively, if the resistance of R3 is decreased, the output current at the output current terminal 328 is decreased. By selecting TRIM_Q according to a measured Q and by use of a target Q or LED brightness, the output current at the output current terminal 328 is selected so that the future (e.g. post-adjusted) Q is uniform with other current control circuits of an LED submodule (e.g., the LED submodules 114A-114H in FIG. 1, or the LED display driver circuit 210 in FIG. 2).

Figure 4:
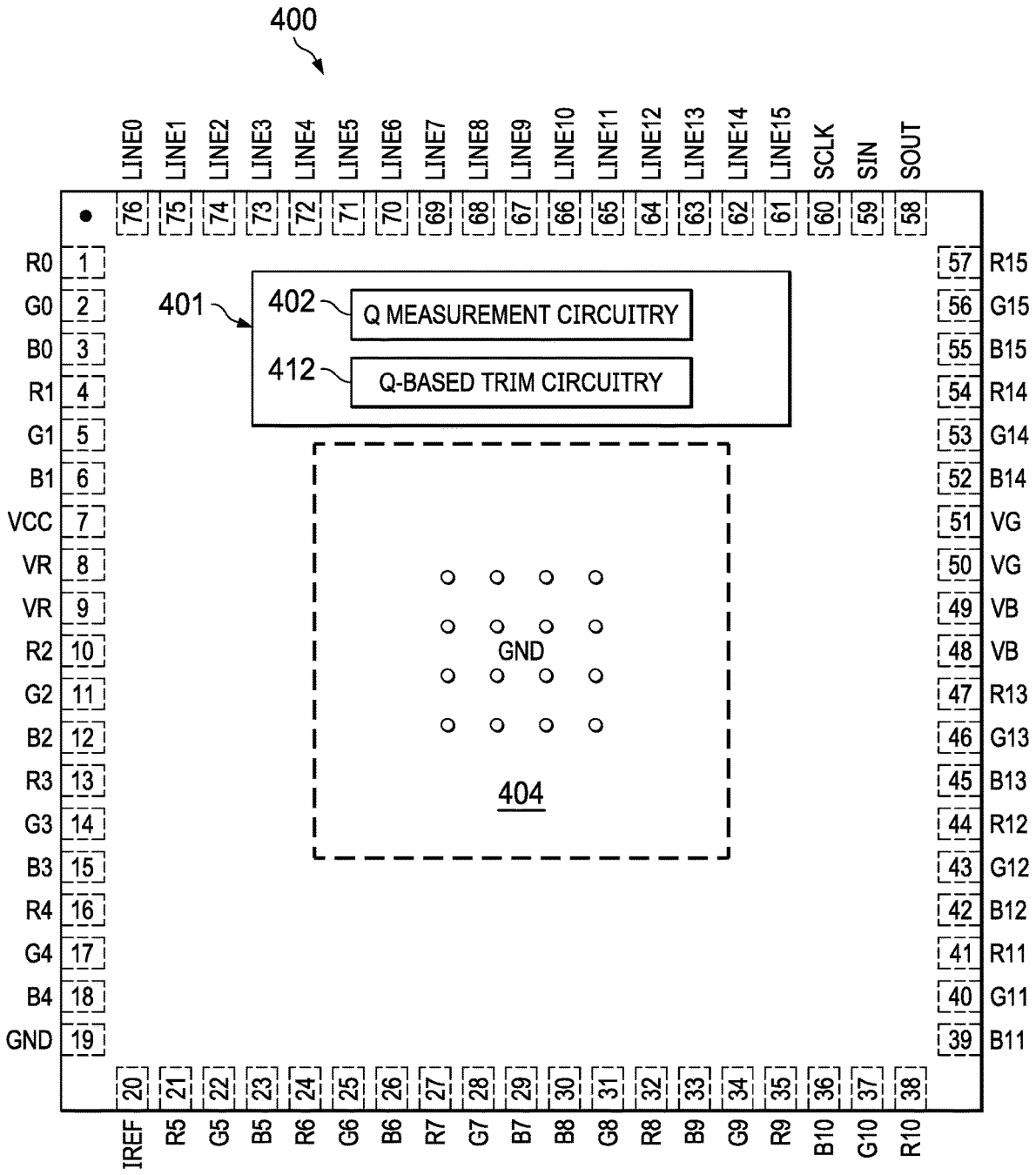
FIG. 4 is an LED display driver circuit layout in accordance with an example embodiment.

FIG. 4 is an LED display driver circuit package (e.g. semiconductor chip package and external connection, pin or terminal layout) layout 400 (e.g., for each of the LED submodules 114A-114H in FIG. 1, or the LED display driver circuit 210 of FIG. 2) in accordance with an example embodiment. As shown, the LED display driver integrated circuit included in the package includes control circuitry 401 having Q measurement circuitry 402 (e.g., the Q measurement circuits 132A-132N in FIGS. 1 and 2, or the test logic 304 of the Q measurement circuit 302 or 302A in FIG. 3) and Q-based trim circuitry 412 (e.g., the Q-based trim circuits 134A-134N in FIGS. 1 and 2, or the Q-based trim measurement circuit 312 or 312A in FIG. 3). Example components of the Q measurement circuitry 402 and the Q-based trim circuitry 412 are described in FIGS. 1-3. In some example embodiments, the Q measurement circuitry 402 includes test logic (e.g., the test logic 304 in FIG. 3, such as a pulse generator, communication interface, and storage). During a Q measurement scenario, the test logic provides an on-pulse at each channel output. Also, external test circuitry enables calculation of a Q value or other LED brightness estimate. In some example embodiments, the Q-based trim circuitry 412 includes a separate current control circuit (e.g., the current control circuit 312 or 312A) with a trimmable component for each channel and/or color.

As shown, the LED display driver circuit layout 400 also include ground connections 404 (e.g., implemented using ball bonds) as well as plurality of pins or contacts 1-76. More specifically, there are respective pins (pins 1-6, 10-18, and 21-57) for red-blue-green (RGB) pixels of 16 channels (R0-R16, G0-B15, B0-B15). There are also respective pins (pins 7-9, 19-20, and 48-51) for a supply voltage (VCC), a red output supply voltage (VR), a blue output supply voltage (VB), a green output supply voltage (VG), and ground (GND), and a reference current (IREF). There are also respective pins (pins 7-9, 19, and 20) for a clock signal (SCLK), a data input (SIN), and a data output (SOUT) for communications in accordance with a protocol such as serial peripheral interface (SPI). There are also respective pins (pins 61-76) for 16 scan line outputs (Line0-Line15). In some example embodiments, an LED display driver circuit related to the LED display driver circuit layout 400 includes a current source for each channel for use with common cathode LEDs. In such case, the Line0-Line15 pins are coupled to LED anodes, while R0-R15 pins, G0-G15 pins, and B0-B15 pins are coupled to LED cathodes. In other example embodiments, an LED display driver circuit related to the LED display driver circuit layout 400 includes a current sink for each channel for use with common anode LEDs. In such case, the Line0-Line15 pins are coupled to LED cathodes, while R0-R15 pins, G0-G15 pins, and B0-B15 pins are coupled to LED anodes. In operation, the control circuitry 401 is used to avoid or correct for non-uniformity in LED brightness levels of the LED display driver circuit related to the LED display driver circuit layout 400.

In some example embodiments, test logic of the Q measurement circuitry 402 includes a communication interface and storage coupled to the communication interface. The communication interface is adapted to be coupled to test equipment and to receive an LED brightness estimate for each channel from the test equipment. The storage is configured to store the LED brightness estimate for each channel. The stored values are used directly or indirectly to provide a trim control signal for each channel's respective current control circuit as described herein.

Figure 5:
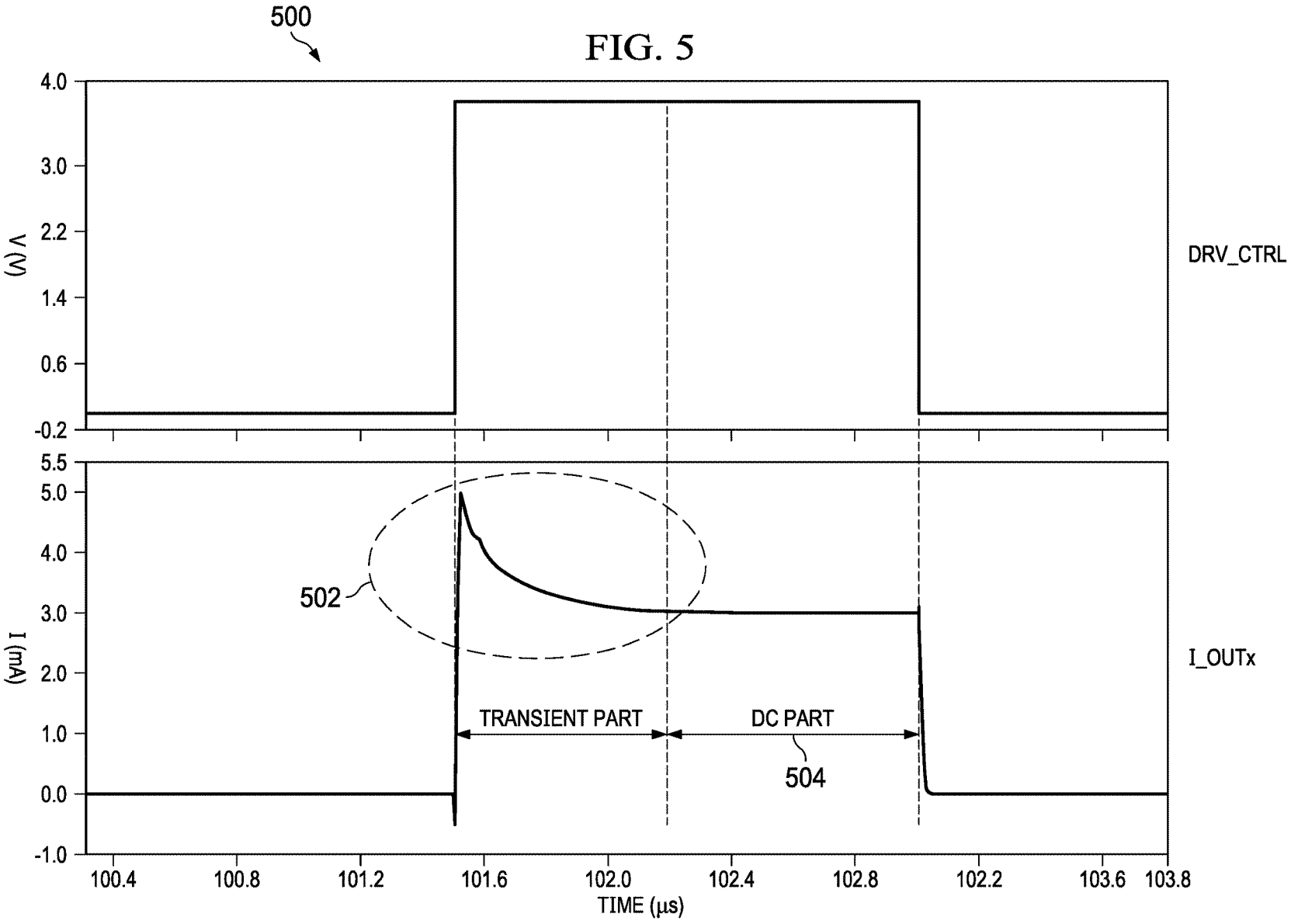
FIG. 5 is a timing diagram of a driver control signal and an output current of a channel of an LED display driver circuit.

FIG. 5 is a timing diagram 500 of a driver control signal (DRV_CTRL) and the output current (I_OUTx) of a channel of an LED display driver circuit. As shown in the timing diagram 500, I_OUTx rises responsive to assertion of DRV_CTRL. In the example of FIG. 5, the pulse of I_OUTx includes a transient part 502 and a DC part 504. When the LED brightness level is higher than a threshold, the duration of the DC part 504 of I_OUTx exceeds the duration of the transient part 502 such that LED brightness non-uniformity is not prevalent. On the other hand, when the LED brightness level is at or below the threshold, the duration of the transient part 502 of I_OUTx exceeds the duration of the DC part 504 and LED brightness non-uniformity is prevalent due to the transient part 502 having variance across LED display driver circuits. With the described Q measurement circuit and Q-based trim circuitry, LED brightness non-uniformity at LED brightness levels at or below the threshold is avoided or corrected by adjusting the output current responsive to a Q measurement or other LED brightness estimate.

Figure 6:
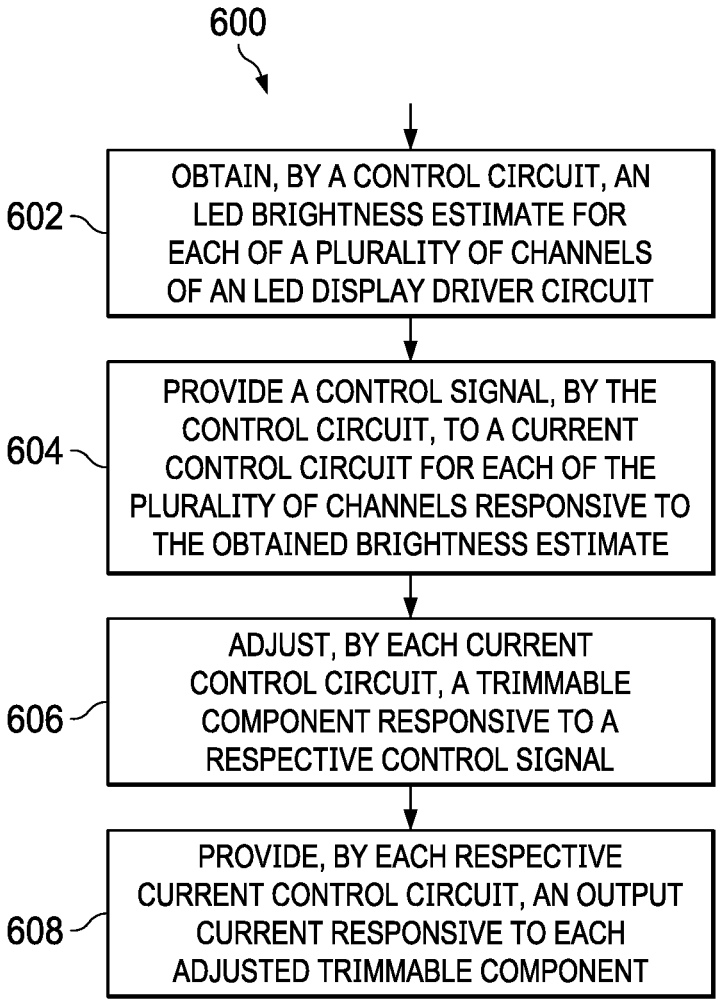
FIG. 6 is a flow chart of an LED display driver circuit method in accordance with an example embodiment.

FIG. 6 is a flow chart of an LED display driver circuit method of operation 600 in accordance with an example embodiment. The method 600 is performed, for example, by an LED display driver circuit (e.g., one of the LED submodules 114A-114H of FIG. 1, the LED display driver circuit 210 in FIG. 2, an LED display driver circuit related to the LED display driver circuit layout 400 in FIG. 4) to avoid or correct for LED brightness non-uniformity. As shown, the method 600 includes obtaining, by control circuitry, an LED brightness estimate for each of a plurality of channels at block 602. In some example embodiments, the brightness estimate is a Q value as described herein. At block 604, a control signal is provided, by the control circuitry, to a current control circuit for each of the plurality of channels responsive to the obtained brightness estimate. At block 606, a trimmable component is adjusted, by each current control circuit, responsive to a respective control signal. In some example embodiments, the trimmable component is a trimmable resistor (e.g., R3 in FIG. 3) as described herein. At block 608, an output current is provided, by each respective current control circuit, responsive to each adjusted trimmable component.

In some example embodiments, the method 600 includes obtaining each LED brightness estimate from external test circuitry that calculates a current integration or Q value for each respective channel. In some example embodiments, the current integration value is calculated using Equation 1 or another current integration model.

In some example embodiments, an LED display driver circuit (e.g., each of the LED submodules 114A-114H in FIG. 1, the LED display driver circuit 210 in FIG. 2, or the LED display driver circuit related to the LED display driver circuit layout 400 in FIG. 4) includes: a set of channels (e.g., channels 130A-130N in FIG. 1, channels 201A-201N in FIG. 2, channels for R0R-15, G0-G15, and B0-B15 in FIG. 4) each channel of the set of channels having a respective current control circuit (e.g., the current control circuits 212A-212N, 214A-214N, 216A-216N in FIG. 2, or the current control circuit 312 and 312A in FIG. 3 The LED display driver circuit also includes control circuitry (e.g., Q measurement circuits 132A-132N and Q-based trim circuits 134A-134N in FIGS. 1 and 2, part of the Q measurement circuit 302 or 302A in FIG. 3, the Q-based trim circuit 312 or 312A in FIG. 3, the Q measurement circuit 402 in FIG. 4, or the Q-based trim circuitry 412 in FIG. 4) coupled to each respective current control circuit and configured to adjust a respective control signal to each respective current control circuit responsive to a LED brightness estimate for each channel of the set of channels. The LED display driver circuit also includes an output (e.g., R0-R15, B0-B15, G0-G15 in FIG. 4) for each channel of the set of channels, wherein the control circuitry includes a test logic including pulse generator (e.g., the test logic 304 in FIG. 3) configured to provide a respective on-pulse (e.g., I_OUTx in FIG. 6) to each output to determine the brightness estimate.

In some example embodiments, Q measurements involve coupling the LED display driver circuit to an external test circuit that includes a respective RC filter between each output and a ground (e.g., the ground 306 in FIG. 3), each RC filter in parallel with a respective load (e.g., Rload in FIG. 3) between each output and the ground, and each RC filter having a resistor (e.g., R1 in FIG. 3) in series with a capacitor (e.g., C1 in FIG. 3). In some example embodiments, the external test circuit also includes a processor (e.g., the processor 310 in FIG. 3) configured to calculate a current integration value as the brightness estimate responsive to a sense voltage (VM) between each respective resistor and capacitor. In some example embodiments, the processor is configured to calculate the current integration value for each channel using Equation 1 or another current integration model. In some example embodiments, the external test circuit includes an ADC 308 configured to provide a digital value of VM to the processor.

In some example embodiments, each current control circuit includes a trimmable component (e.g., R3 in FIG. 3) responsive to a respective control signal (e.g., TRIM_Q in FIG. 3) from the control circuitry. In some example embodiments, each current control circuit includes a voltage supply input (e.g., the VLED input 316); a bias current source (e.g., the bias current source 318) configured to provide a bias current responsive to a voltage at the voltage supply input; and a trimmable component having a first end and a second end, the first end coupled to the bias current source. The trimmable component (e.g., R3 in FIG. 3) is configured to adjust its resistance responsive to a respective control signal (e.g., TRIM_Q) from the control circuitry; and a transistor (e.g., M1 in FIG. 3) having a first current terminal, a second current terminal, and a control terminal, the first current terminal coupled to the second end of the trimmable component, and the second current terminal coupled to a ground (e.g., ground 326). In some example embodiments, the transistor (e.g., M1 in FIG. 3) is a first transistor, and the current control circuit also includes: a second transistor (e.g., M2 in FIG. 3) having a first current terminal, a second current terminal and a control terminal, the first current terminal of the second transistor coupled to the voltage supply input, the second current terminal of the second transistor coupled to the first current terminal of the first transistor; and a third transistor (e.g., M3 in FIG. 3) having a first current terminal, a second current terminal and a control terminal, the first current terminal of the third transistor coupled to the voltage supply input; and a fourth transistor having a first current terminal, a second current terminal and a control terminal, the first current terminal of the fourth transistor coupled to the second current terminal of the third transistor supply input, and the second current terminal of the fourth transistor coupled to a respective output.

In some example embodiments, the current control circuit also includes: an operational amplifier (e.g., the operational amplifier 322 in FIG. 3) having non-inverting input, an inverting input and an operational amplifier output, the inverting input coupled to the bias current source via a first switch (e.g., S1 in FIG. 3), the inverting input coupled to the second current terminal of the third transistor via a second switch (e.g., S2 in FIG. 3), the operational amplifier output coupled to the control terminal of the first transistor, and the operational amplifier output coupled to the control terminal of the fourth transistor via a third switch (e.g., S3 in FIG. 3); and a fixed resistor (e.g., R2 in FIG. 3) and a fourth switch (e.g., S4 in FIG. 3) coupled is series between the voltage supply input and the control terminal of the fourth transistor.

In some example embodiments, a system (e.g., the system 100 in FIG. 1) includes: a PCB (e.g., a PCB for each of the LED modules 110A-110N in FIG. 1); an LED display controller (e.g., the on-board controller 118 in FIG. 1) mounted on the PCB; a graphics card (e.g., the DVI graphics card 104 in FIG. 1) coupled to the PCB and configured to provide graphics data to the LED display controller, wherein the LED display controller is configured to generate LED data based on the graphics data; and a plurality of LED display driver circuits (e.g., each of the LED submodules 114A-114H in FIG. 1, the LED display driver circuit 210 in FIG. 2, or the LED display driver circuit related to the LED display driver circuit layout 400 in FIG. 4) coupled to the LED display controller, each LED display driver circuit configured to receive respective LED data from the LED display controller and including: a set of channels (e.g., channels 130A-130N in FIG. 1, channels 201A-201N in FIG. 2, channels for R0R-15, G0-G15, and B0-B15 in FIG. 4), each channel of the set of channels having a respective current control circuit (e.g., the current control circuits 212A-212N in FIG. 2, or the current control circuit 312 or 312A in FIG. 3); and control circuitry (e.g., Q measurement circuits 132A-132N and Q-based trim circuits 134A-134N in FIGS. 1 and 2, part of the Q measurement circuit 302 or 302A, the Q-based trim circuit 312 or 312A in FIG. 3, the Q measurement circuit 402 in FIG. 3, or the Q-based trim circuitry 412 in FIG. 4) coupled to each respective current control circuit and configured to adjust a respective control signal to each respective current control circuit responsive to an LED brightness estimate (e.g., a Q value) for each channel of the set of channels.

In some example embodiments, the LED display driver circuit includes: an output (e.g., R0-R15, B0-B15, G0-G15 in FIG. 4) for each channel of the set of channels, wherein the control circuitry includes a test logic including a pulse generator (e.g., the test logic 304 in FIG. 3) configured to provide a respective on-pulse (e.g., I_OUTx in FIG. 6) to each output. The system also includes external test circuitry including a respective RC filter between each output and a ground (e.g., the ground 306 in FIG. 3), each RC filter in parallel with a respective load (e.g., Rload in FIG. 3) between each output and the ground, and each RC filter having a resistor (e.g., R1 in FIG. 3) in series with a capacitor (e.g., C1 in FIG. 3). In some example embodiments, the external test circuit also includes a processor (e.g., the processor 310 in FIG. 3) configured to calculate a current integration value as the LED brightness estimate responsive to a sense voltage (VM) between each respective resistor and capacitor. In some example embodiments, the processor configured to calculate the current integration value for each channel as $$Q = \frac{VM * tp}{Rload},$$

where Q is the current integration value, tp is the on-pulse period, and Rload is a respective load resistance. In some example embodiments, each current control circuit includes a trimmable resistor (e.g., R3 in FIG. 3) responsive to a respective control signal (based on the respective Q value) from the control circuit.

In this description, the term "couple" may cover connections, communications, or signal paths that enable a functional relationship consistent with this description. For example, if device A generates a signal to control device B to perform an action: (a) in a first example, device A is coupled to device B by direct connection; or (b) in a second example, device A is coupled to device B through intervening component C if intervening component C does not alter the functional relationship between device A and device B, such that device B is controlled by device A via the control signal generated by device A.

Modifications are possible in the described embodiments, and other embodiments are possible, within the scope of the claims. Unless specified to the contrary above, the terms "node", "terminal", "pin" and "connection" are used interchangeably and are not meant to require a particular electrical or physical structure. Furthermore, the terms "pin", "lead", "connector", "ball bonds" and "external connection" are used interchangeably and are not meant to require a particular electrical or physical structure. These terms are intended to be used broadly as merely an interconnection between two components or as the terminus of a component (e.g. a resistor may have two "terminals" or "ends" and a transistor may have three "terminals" or a gate, source and drain).

What is claimed is:

1. A light-emitting diode (LED) display driver circuit, comprising:

a set of channels, each channel of the set of channels having a respective current control circuit;

control circuitry having a control signal output coupled to each respective current control circuit, the control circuitry operable to adjust the control signal output to each respective current control circuit responsive to an LED brightness estimate for each channel of the set of channels; and wherein each LED brightness estimate is a current integration value for each channel.

2. The LED display driver circuit of claim 1, further comprising an output for each channel of the set of channels, wherein the control circuitry includes test logic coupled to each output and configured to provide a respective on-pulse to each output.

3. The LED display driver circuit of claim 2, wherein the control circuitry includes a communication interface and storage coupled to the communication interface, the communication interface is adapted to be coupled to test equipment and to receive an LED brightness estimate for each channel from the test equipment, and the storage configured to store the LED brightness estimate for each channel.

4. The LED display driver circuit of claim 1, wherein each current control circuit includes an adjustable resistor responsive to a respective control signal from the control circuit.

5. A light-emitting diode (LED) display driver circuit, comprising:

a set of channels, each channel of the set of channels having a respective current control circuit;

control circuitry having a control signal output coupled to each respective current control circuit, the control circuitry operable to adjust the control signal output to each respective current control circuit responsive to an LED brightness estimate for each channel of the set of channels; and wherein each current control circuit includes:

a voltage supply input;

a bias current source configured to provide a bias current responsive to a voltage at the voltage supply input; and an adjustable component having a first end and a second end, the first end coupled to the bias current source, and the adjustable component configured to adjust its resistance responsive to a respective control signal from the control circuit.

6. The LED display driver circuit of claim 5, wherein each current control circuit includes:

a first transistor having a first current terminal, a second current terminal, and a control terminal, the first current terminal coupled to the second end of the adjustable component, and the second current terminal coupled to a ground; and a second transistor having a first current terminal, a second current terminal and a control terminal, the first current terminal of the second transistor coupled to the voltage supply input, the second current terminal of the second transistor coupled to the first current terminal of the first transistor.

7. The LED display driver circuit of claim 6, wherein each current control circuit includes:

a third transistor having a first current terminal, a second current terminal and a control terminal, the first current terminal of the third transistor coupled to the voltage supply input; and a fourth transistor having a first current terminal, a second current terminal and a control terminal, the first current terminal of the fourth transistor coupled to the second current terminal of the third transistor supply input, and the second current terminal of the fourth transistor coupled to a respective output.

8. The LED display driver circuit of claim 7, wherein each current control circuit includes:

an operational amplifier having non-inverting input, an inverting input and an operational amplifier output, the inverting input coupled to the bias current source via a first switch, the inverting input coupled to the second current terminal of the third transistor via a second switch, the operational amplifier output coupled to the control terminal of the first transistor, and the operational amplifier output coupled to the control terminal of the fourth transistor via a third switch; and a fixed resistor and a fourth switch coupled is series between the voltage supply input and the control terminal of the fourth transistor.

9. A system, comprising:

a light-emitting diode (LED) display controller having LED data output;

a graphics card having a graphics data output coupled to the LED display controller, wherein the LED display controller is configured to generate LED data based on graphics data from the graphics data output; and a plurality of LED display driver circuits coupled to the LED data output, each LED display driver circuit including:

a set of channels, each channel of the set of channels having a respective current control circuit;

control circuitry coupled to each respective current control circuit and configured to adjust a respective control signal to each respective current control circuit responsive to an LED brightness estimate for each channel of the set of channels; and wherein the control circuitry is configured to calculate a current integration value as the LED brightness estimate responsive to a sense voltage (VM).

10. The system of claim 9, wherein the LED display driver circuit includes:

an output for each channel of the set of channels, wherein the control circuitry includes test logic, a communication interface, and storage, the test logic configured to provide a respective on-pulse to each output, and the communication interface is adapted to be coupled to a test circuit and to receive an LED brightness estimate for each channel from the test circuit.

11. The system of claim 10, wherein the test circuit includes a processor and a respective resistor-capacitor (RC) filter between each output and a ground, each respective RC filter in parallel with a respective load between each output and the ground, and each respective RC filter having a resistor in series with a capacitor, wherein the sense voltage (VM) is sensed between the respective resistor and capacitor of each RC filter.

12. The system of claim 11, wherein the processor is configured to calculate the current integration value for each channel as $$Q = \frac{VM * tp}{Rload},$$

where Q is the current integration value, tp is the on-pulse period, and Rload is a respective load resistance.

13. The system of claim 9, wherein each current control circuit includes a trimmable resistor responsive to a respective control signal from the control circuit.

14. The system of claim 9, wherein each current control circuit includes:

a voltage supply input;

a bias current source configured to provide a bias current responsive to a voltage supply input;

a trimmable component having a first end and a second end, the first end coupled to the bias current source, and the trimmable component configured to adjust its resistance responsive to a respective control signal from the control circuit; and a transistor having a first current terminal, a second current terminal, and a control terminal, the first current terminal coupled to the second end of the trimmable component, and the second current terminal coupled to a ground.

15. The system of claim 14, wherein the transistor is a first transistor, and each current control circuit includes:

a second transistor having a first current terminal, a second current terminal and a control terminal, the first current terminal of the second transistor coupled to the voltage supply input, the second current terminal of the second transistor coupled to the first current terminal of the first transistor;

a third transistor having a first current terminal, a second current terminal and a control terminal, the first current terminal of the third transistor coupled to the voltage supply input;

a fourth transistor having a first current terminal, a second current terminal and a control terminal, the first current terminal of the fourth transistor coupled to the second current terminal of the third transistor supply input, and the second current terminal of the fourth transistor coupled to a respective output.

16. The system of claim 15, wherein each current control circuit includes:

an operational amplifier having non-inverting input, an inverting input and an operational amplifier output, the inverting input coupled to the bias current source via a first switch, the inverting input coupled to the second current terminal of the third transistor via a second switch, the operational amplifier output coupled to the control terminal of the first transistor, and the operational amplifier output coupled to the control terminal of the fourth transistor via a third switch; and a fixed resistor and a fourth switch coupled is series between the voltage supply input and the control terminal of the fourth transistor.

17. A method, comprising:

obtaining, by a control circuit, a light-emitting diode (LED) brightness estimate for each of a plurality of channels of an LED display driver circuit;

providing a control signal, by the control circuit, to a current control circuit for each of the plurality of channels responsive to the obtained LED brightness estimate;

adjusting, by each current control circuit, a resistance responsive to a respective control signal;

outputting, by each respective current control circuit, a current responsive to each adjusted resistance; and wherein obtaining each LED brightness estimate involves calculating a current integration value for each respective channel.

18. The method of claim 17, wherein the current integration value is calculated as $$Q = \frac{VM * tp}{Rload},$$

where Q is the current integration value, tp is the on-pulse period, and Rload is a respective load resistance.

19. The method of claim 17, wherein adjusting the resistance involves providing a control signal to a trimmable component.

* * * * *